US007518956B1

(12) United States Patent
Hansel

(10) Patent No.: US 7,518,956 B1
(45) Date of Patent: Apr. 14, 2009

(54) PLANISPHERE CLOCK

(75) Inventor: Douglas D. Hansel, Lewis Center, OH (US)

(73) Assignee: Trident Design, LLC, Columbus, OH (US)

( * ) Notice: Subject to any disclaimer, the term of this patent is extended or adjusted under 35 U.S.C. 154(b) by 0 days.

(21) Appl. No.: 11/537,129

(22) Filed: Sep. 29, 2006

Related U.S. Application Data

(60) Provisional application No. 60/722,181, filed on Sep. 30, 2005.

(51) Int. Cl.
*G04B 49/00* (2006.01)

(52) U.S. Cl. ..... 368/15; 368/27

(58) Field of Classification Search ..... 368/21, 368/15–20, 27, 223
See application file for complete search history.

(56) References Cited

U.S. PATENT DOCUMENTS

| | | | | |
|---|---|---|---|---|
| 1,459,710 | A * | 6/1923 | Balch | 368/17 |
| 3,248,866 | A * | 5/1966 | Spilhaus | 368/19 |
| 4,579,460 | A | 4/1986 | Shannon | |
| 4,731,767 | A * | 3/1988 | Uehara | 368/15 |
| 5,519,673 | A | 5/1996 | Uehara et al. | |
| 5,744,695 | A | 4/1998 | Forbes | |
| 6,744,695 | B2 * | 6/2004 | Goldberg | 368/15 |
| 2006/0164920 | A1 * | 7/2006 | Brophy | 368/15 |

OTHER PUBLICATIONS

Alway, Peter, Planisphere, webpages from: http://www-personal.umich.edu/~dgs/alway/planisphere.htm, Sep. 21, 2006.

* cited by examiner

*Primary Examiner*—Vit W Miska
*Assistant Examiner*—Sean Kayes
(74) *Attorney, Agent, or Firm*—Standley Law Group LLP

(57) ABSTRACT

A timepiece for displaying a planisphere and indicating a portion of the planisphere. Another exemplary embodiment is a clock that displays both sidereal and solar time, while indicating a portion of the planisphere at a particular time. Another exemplary embodiment of the timepiece includes an adjustment feature that allows a user to adjust the portion of the planisphere indicated to a particular geographic location. An exemplary embodiment may contain a celestial or terrestrial planisphere. As a result, an exemplary embodiment of the timepiece may provide valuable information about the planisphere at any particular sidereal or solar time.

26 Claims, 16 Drawing Sheets

UTC / Sidereal Time Continuum

A Longitude

| | | | | | | | | | | | | | | | | | |
|---|---|---|---|---|---|---|---|---|---|---|---|---|---|---|---|---|---|
| | | | | | | | | | | | | | | | | … | 166 |
| | | | | | | | | | | | | | | | | | |
| | | | | | | | | | | | | | | | | | |
| | | | | | | | | | | | | | | | | |

PLANISPHERE CLOCK

This application claims the benefit of U.S. Provisional Application No. 60/722,181, filed Sep. 30, 2005, which is hereby incorporated by reference in its entirety.

BACKGROUND AND SUMMARY OF THE INVENTION

The present invention relates generally to a planisphere timepiece that may visually display sidereal time and/or solar time.

Time may be measured in different ways. Sidereal time, also known as "star time", is the measurement of time based on the apparent motion of the stars due to the rotation of the earth or any other celestial body. A sidereal day lasts from when a distant star appears on an observer's celestial meridian until it next appears on the observer's celestial meridian. Sidereal time is useful in the field of astronomy. For example, star coordinates are often written in sidereal time. In particular, sidereal time equals the right ascension of any point on the celestial sphere of the sky that crosses a meridian at a given moment. For this reason, sidereal time may be used by astronomers and backyard stargazers alike to determine which astronomical objects may be visible at a given time.

Unlike sidereal time, solar time, which is also commonly referred to as "local time," is based on the apparent movement of the sun relative to Earth. In particular, solar time is based on the sun's daily crossing of an observer's local longitudinal meridian, which is the 24-hour period tracked by many typical timepieces such as wall clocks and watches. Solar noon is specifically defined as the moment when the sun is at its highest point in the sky, although many timepieces may not accurately reflect solar noon due to time zones and daylight savings time. In addition, the time taken for the sun to return to its highest point is exactly 24 hours, or a solar day. A solar day is slightly longer than a sidereal day (i.e., a sidereal day lasts about 23 hours and 56 minutes).

Primarily for human convenience, local time has evolved into the modern standard of Coordinated Universal Time (i.e., UTC), which has been adopted over longitudinal time zones as a means of standardization. Time zones are based off of a zero UTC hour longitudinal coordinate that runs through Greenwich, England. In the United States, there are four different time zones. The Eastern time zone is five hours behind Greenwich, England, or "−5 UTC," whereas the Central, Mountain, and Pacific time zones are −6 UTC, −7 UTC, and −8 UTC, respectively.

Celestial planispheres may be useful for determining the position of the stars and constellations. Celestial planispheres are typically an assembly including a rotatable, circular map of the heavens used to locate and identify stars and constellations relative to calendar and local time information. Based on the date, local time, and location of a user, a celestial planisphere may provide the user with a map view of the stars and other astronomical features that may be found in the sky.

A celestial planisphere must be calibrated in order to provide accurate information. In particular, since sidereal time varies depending on the longitudinal position on the Earth as well as the local time and date, there is a need to be able to calibrate a celestial planisphere to the user's particular geographic location to ensure that the planisphere is accurate. In addition, there is a need for a celestial planisphere that may provide an indication of sidereal time. Moreover, in light of the differences between sidereal time and local time, there is a need for a celestial planisphere that may provide sidereal time in addition to local time. Such needs are also applicable to other types of planispheres including, but not limited to, terrestrial planispheres.

In light of the aforementioned needs, it may be desirable to have a clock that displays a planisphere and both sidereal time and local time. It may also be desirable to have a clock that not only displays the entire planisphere, but may accurately identify for the user which part of the planisphere may be visible to a user at a given time. In addition, it may be desirable to have a clock that a user may adjust relative to his or her geographic location for accuracy.

One exemplary embodiment of the present invention may be a clock, watch, or other timepiece (e.g., a 24-hour analog timepiece) that includes a planisphere and sidereal time information. An exemplary embodiment of a timepiece may include an adjustment feature that allows a user to adjust the face of the timepiece so that it is accurate for the user's geographic location and/or local time. An exemplary embodiment of the present invention also includes a system and method for indexing a timepiece to take geographic location and/or local time variations into account. Furthermore, another exemplary embodiment of the present invention includes a system and method for providing sidereal time. For example, an exemplary embodiment of the present invention includes a system and method for adapting an automatic quartz solar time mechanism to provide sidereal time.

In addition to the novel features and advantages mentioned above, other features and advantages of the present invention will be readily apparent from the following descriptions of the drawings and exemplary embodiments.

BRIEF DESCRIPTION OF THE DRAWINGS

FIG. 20 is an exemplary embodiment of a chart for determining the amount of adjustment for an exemplary embodiment of a clock of the present invention.

DETAILED DESCRIPTION OF EXEMPLARY EMBODIMENTS

One exemplary embodiment of the present invention is a timepiece with a timing movement and a face that is able to indicate a portion of the planisphere. In some embodiments the timepiece may be a clock, where the clock is able to indicate a portion of a planisphere and display solar time. In other embodiments the timepiece is a clock which indicates a portion of the planisphere, displays both solar and sidereal time, and has an adjustability feature that is able to calibrate the relative portion of the planisphere indicated to a particular geographical location.

Figure 1:
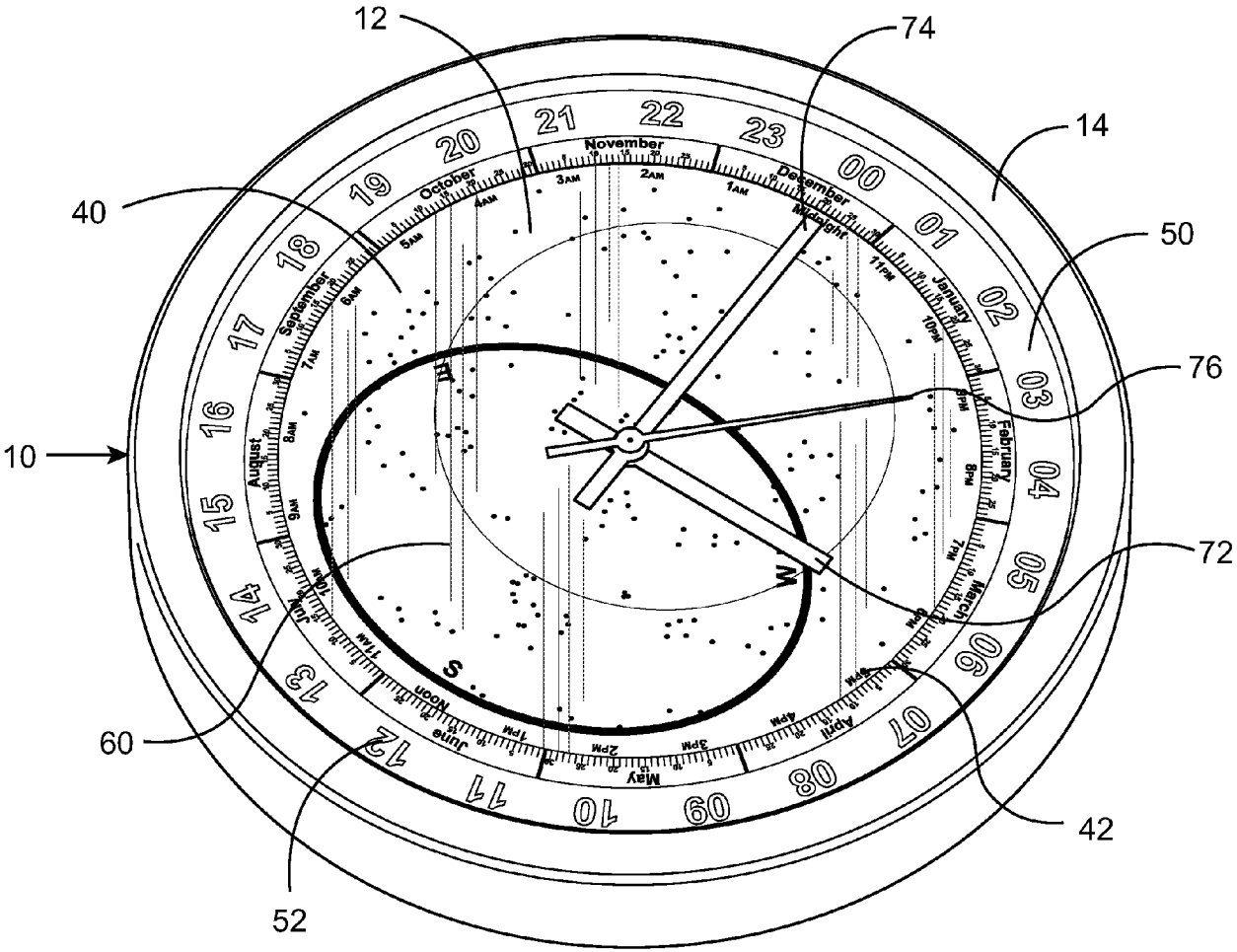
FIG. 1 is a perspective view of an exemplary embodiment of a clock of the present invention.
Figure 2:
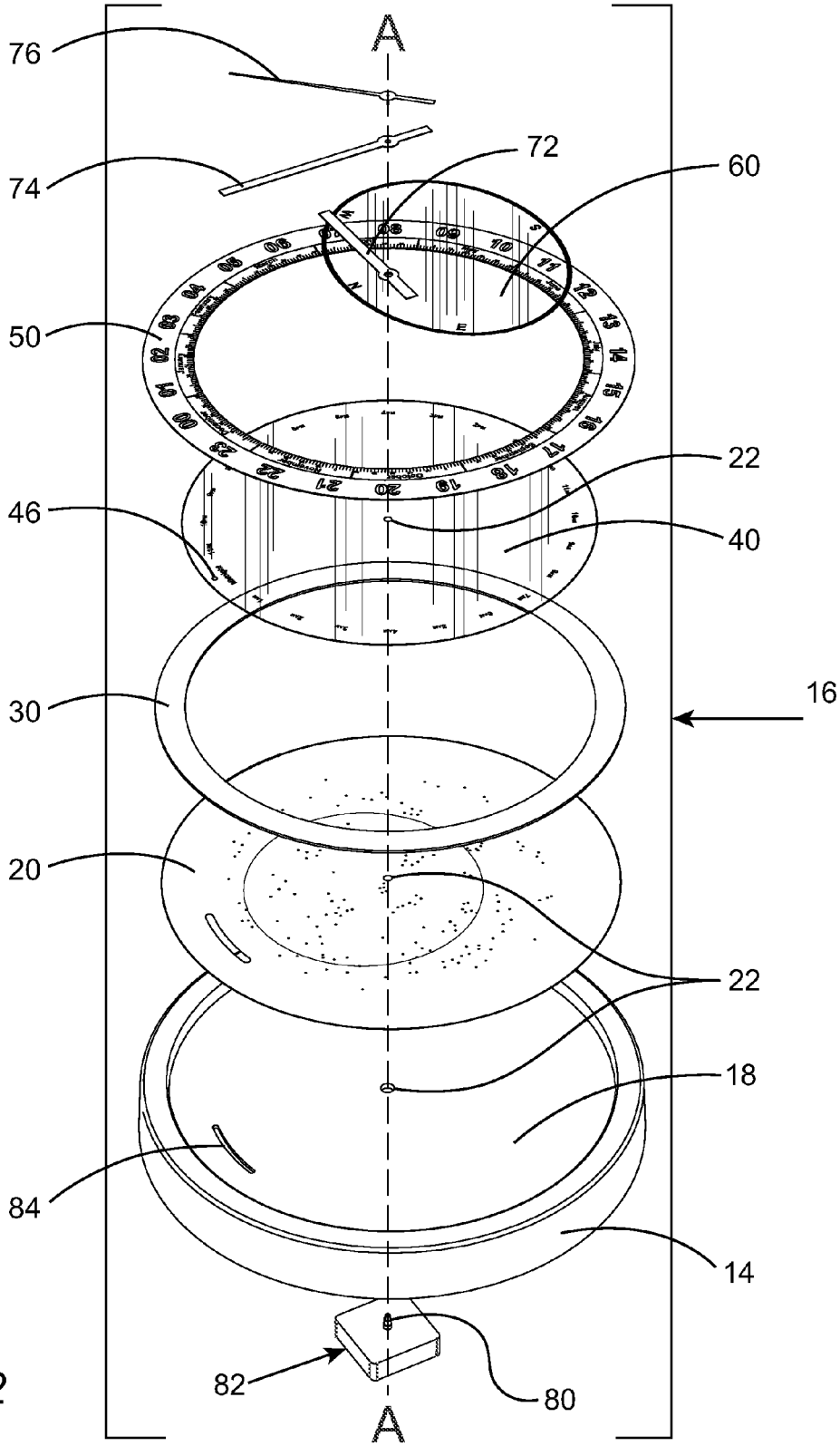
FIG. 2 is an exploded view of an example of the interrelation of layers included in the clock shown in FIG. 1.
Figure 3:
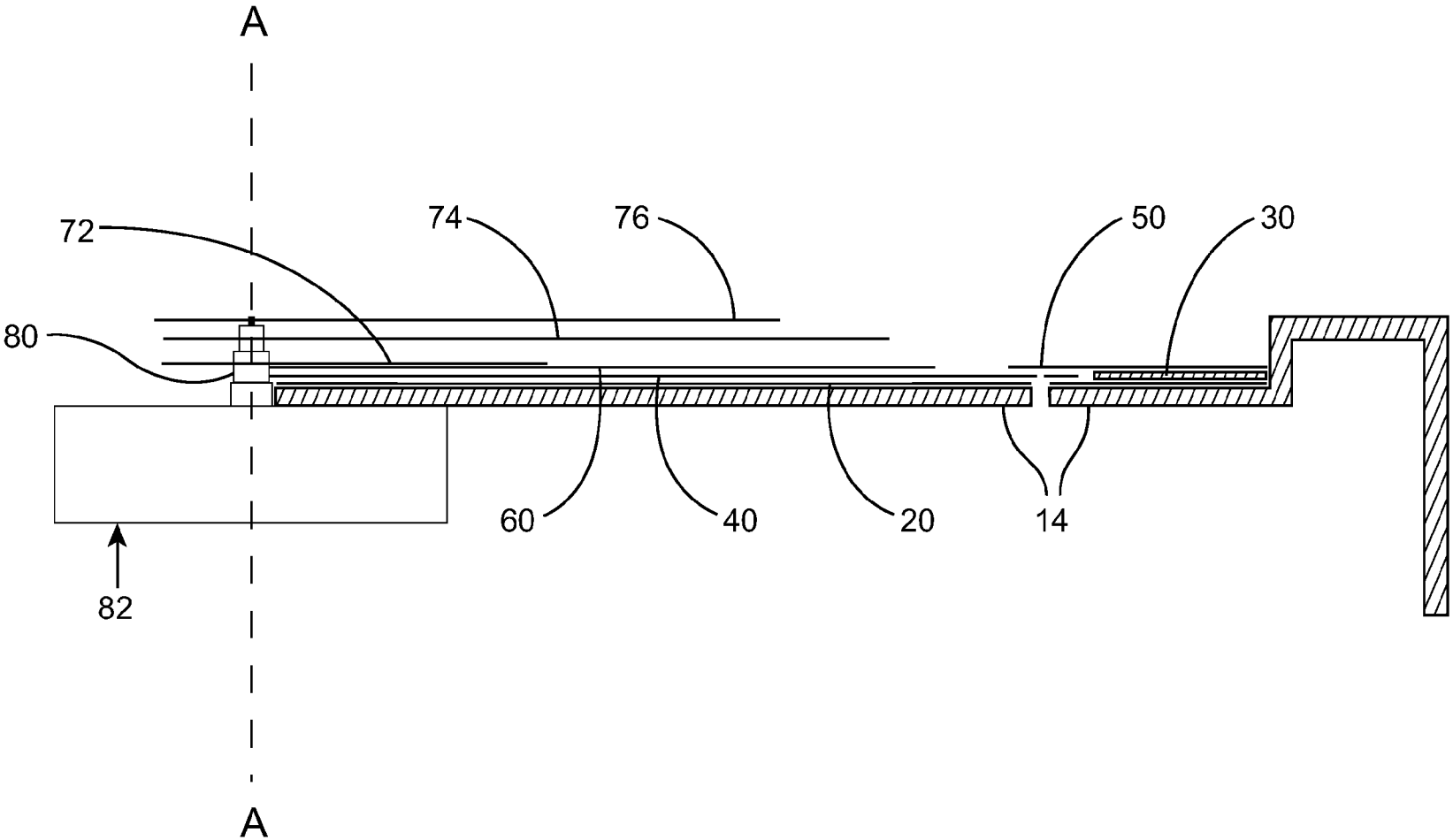
FIG. 3 is a partial cross-sectional view of the clock shown in FIG. 1.

FIGS. 1 and 2 are top perspective and exploded views, respectively, of an exemplary embodiment where the timepiece of the present invention is a clock 10. As shown in these figures, the clock 10 of the present invention may be comprised of a clock face 12, which may optionally be contained within a clock case 14. The clock face 12 may provide visual information to the user regarding time and the positioning of the stars in the sky. As shown in FIGS. 1 and 2, in an exemplary embodiment of the present invention, the clock face 12 may be comprised of several face layers 16. When the clock of the present invention is fully assembled, these face layers may be stacked on one another within an optional recessed front portion 18 of the clock case 14. As shown in FIG. 2 and the cross-sectional view of FIG. 3, starting from the bottommost layer and working upwards, the face layers 16 of this example may include a planisphere layer 20, spacer ring 30, solar time layer 40, sidereal number and calendar ring 50, and indicator layer 60. The face layers 16 will be discussed in further detail at a later point in this description. Located directly above the face layers 16 may be the clock hands, which may include an hour hand 72, minute hand 74, and second hand 76. Some embodiments of the present invention may not require all of these hands. As shown in the embodiment in FIG. 1, all of the face layers 16 and clock hands may optionally be set within the peripheral circumference of the clock case 14. The face layers 16 and clock hands may be intersected by and/or secured to the movement shaft 80 of a timing movement 82, which may optionally be located on the back side of clock case 14. As shown in FIGS. 2 and 3, the movement shaft may be located along an axis A-A that intersects the face layers 16.

Figure 4:
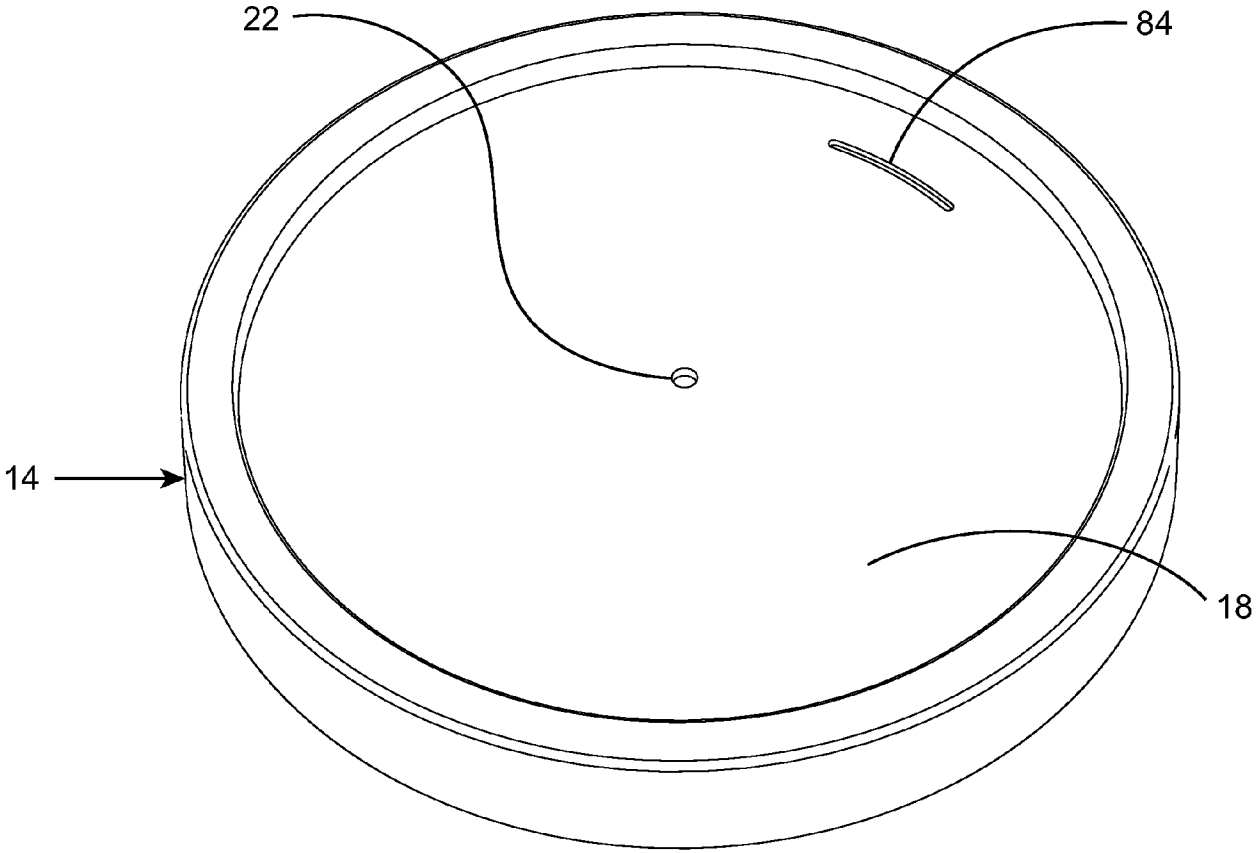
FIG. 4 is a perspective view of the top side of an exemplary embodiment of the clock case included in the clock shown in FIG. 1.
Figure 5:
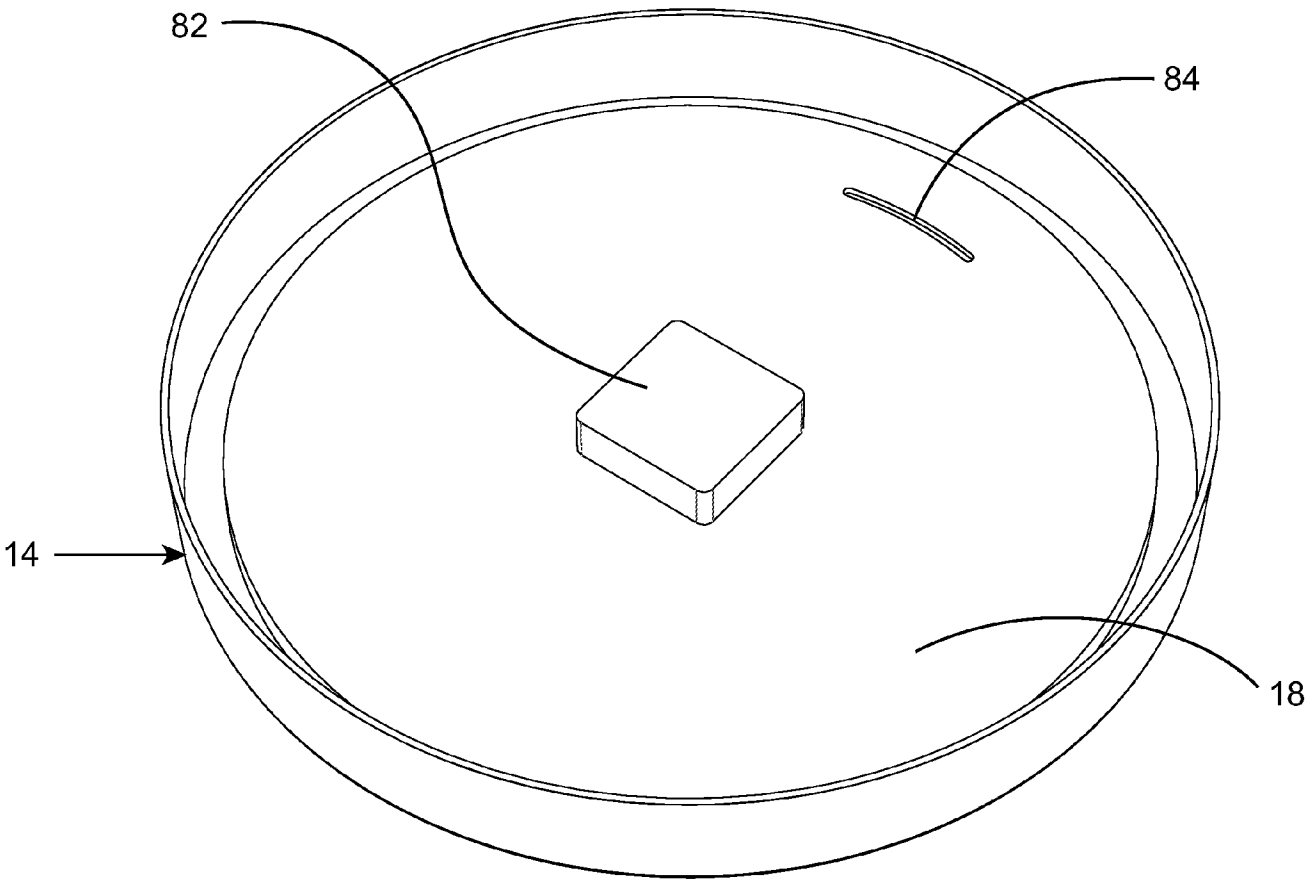
FIG. 5 is a perspective view of the rear side of an exemplary embodiment of the clock case included in the clock shown in FIG. 1.

FIGS. 4 and 5 are perspective views of an exemplary embodiment of a clock case 14 of the present invention. As may be seen in these figures, the clock case 14 may optionally be circular in shape, with a recessed front portion 18 of sufficient depth and peripheral circumference to contain face layers 16. The clock case 14 may also have a hole 22 for accommodating the movement shaft 80 of the timing movement 82. In an exemplary embodiment of the present invention that includes an adjustment feature, an adjustment slot 84 may be located in the recessed front portion 18 (e.g., along the outer periphery). In an exemplary embodiment of the present invention, the adjustment slot 84 may be an oblong cutout in the clock case 14 that is designed to allow access to the face layers 16 from the back of the clock case 14. However, in other embodiments the adjustment slot 84 may be a different shape or located in a different position on the clock case 14. In some embodiments of the present invention, such as those where the clock 10 does not include an adjustment feature, there may be no adjustment slot 84.

In an exemplary embodiment of the present invention, the clock case 14 may be made out of a rigid material such as plastic, metal, or wood. However, in other embodiments of the present invention, other suitable materials may be used. In one exemplary embodiment of the present invention where the clock 10 may be sized to be a wall clock, the recessed front portion 18 of the clock case 14 may be circular and approximately 11.75 inches in diameter. However, other sizes, shapes, and uses are also considered within the scope of the present invention.

Figure 6:
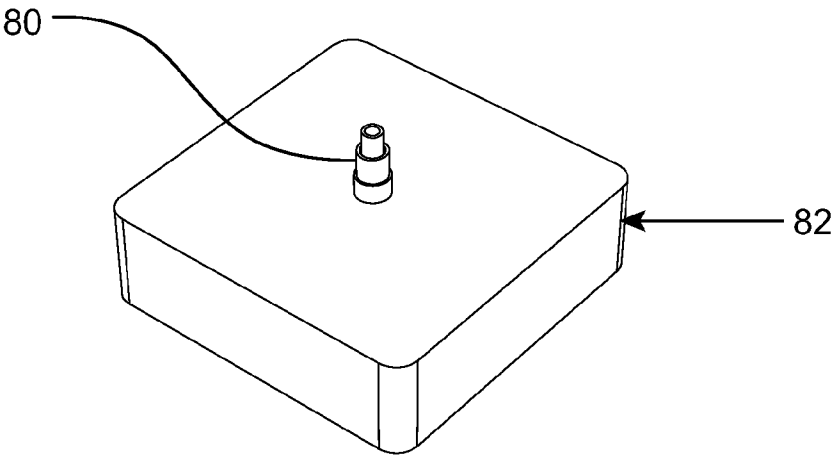
FIG. 6 is a perspective view of an exemplary embodiment of a quartz movement that may be included in the clock shown in FIG. 1.

FIG. 5 shows an exemplary embodiment of the back side of the clock case 14 with a timing movement 82 attached. In this example, the timing movement 82 may be removably mounted to the clock case 14, with the movement shaft 80 engaged in the hole 22 of the clock case 14 (not shown). FIG. 6 is a perspective view of an exemplary embodiment of the timing movement 82, which may be used with the clock 10 of the present invention. As may be seen in FIG. 2 and the cross-sectional view of FIG. 3, as the movement shaft 80 extends along axis A-A towards the front of the clock, the base of the movement shaft 80 may pass through hole 22 in the clock case 14, planisphere layer 20, the solar time layer 40, and an opening or aperture 62 in the indicator layer 60. In particular, in an exemplary embodiment of the present invention, the indicator layer 60 and solar time layer 40 may be connected to the movement shaft 80 in such a way that they may rotate with the hour hand 72. The hour hand 72, minute hand 74, and second hand 76 may all be connected to the movement shaft 80 in a suitable fashion.

Figure 8:
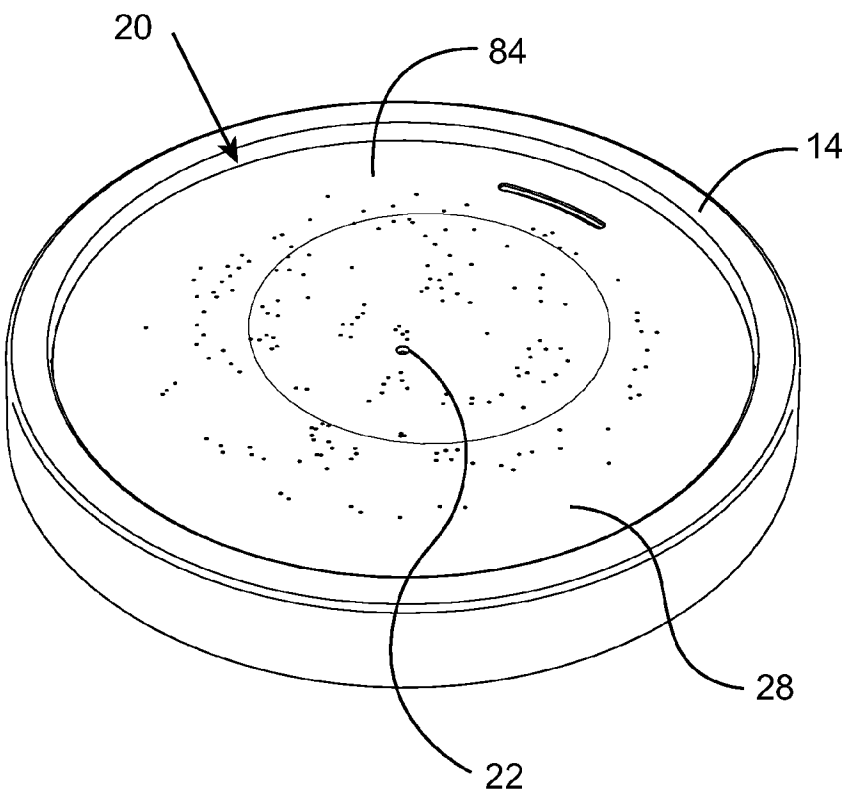
FIG. 8 is a top plan view of an exemplary embodiment of an assembly of the planisphere layer and the clock case included in the clock shown in FIG. 1.
Figure 7:
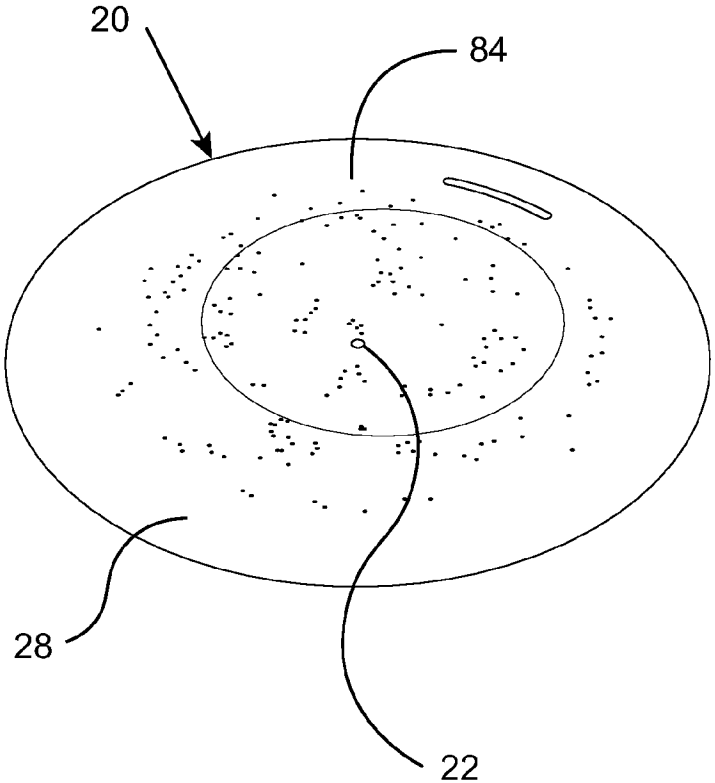
FIG. 7 is a top plan view of an exemplary embodiment of the planisphere layer included in the clock shown in FIG. 1.

As shown in FIG. 2, in an exemplary embodiment of the present invention, the bottommost layer of the clock face 12 may be planisphere layer 20. As shown in the top plan view of FIG. 7, the planisphere layer 20 may be a substantially flat, circular layer sized to fit within the peripheral circumference of the recessed front portion 18 of the clock case 14. The top plan view of FIG. 8 shows the planisphere layer 20 inserted into the recessed front 18 of the clock case 14. At a suitable point of the planisphere layer 20 may be a hole 22, which may have sufficient size and shape to allow for the movement shaft 80 of the timing movement 82 to pass through. In an exemplary embodiment of the present invention, adjustment slot 84 may also extend through planisphere layer 20. However, in other embodiments of the present invention, especially those that do not have an adjustability feature, an adjustability slot may not be present. In an exemplary embodiment of the present invention, the planisphere layer 20 may be approximately 11.75 inches in diameter. However, in other examples of the present invention, such as those where the timepiece of the present invention is a watch, the planisphere layer 20 may be of a smaller or any other desirable size. As shown in close-up detail in the plan view of an exemplary embodiment of a clock in FIG. 9, the top surface of a planisphere layer 20 may be illustrated with a celestial planisphere. This may include stars 24 of the sky, as well as additional markings that indicate the location of constellations 26 and other astronomical objects of the sky. Different features of the sky may also be labeled. Some embodiments of a planisphere layer of the present invention may differ in the representation and labeling of astronomical objects in the sky. For example, one embodiment of the present invention may only include an illustration of the brightest stars in the sky. Another embodiment may include the constellations, represented not only as stars but also with pictorial zodiac images of each constellation. The different embodiments may depend on the sophistication of the intended user, whether a child or an astronomy enthusiast. In some alternative embodiments, the planisphere layer may have an illustration of the terrestrial planisphere on it instead of the celestial planisphere. An exemplary embodiment of a terrestrial planisphere clock of the present invention can be seen in FIG. 19. In these embodiments, different features of the earth's surface may be illustrated or labeled. In an exemplary embodiment of the present invention, the illustrations on the planisphere layer 20 may be located on an inner portion 28 of the layer as dictated by an inner diameter. This inner portion may comprise the background of the clock face 12. In this embodiment, the inner diameter may be approximately the diameter of the clock face 12 minus the cross sectional width of the sidereal number and calendar ring 50. However, in other embodiments of the present invention the illustrations may cover either a smaller or larger portion (e.g., the entirety) of the planisphere layer 20.

In an exemplary embodiment of the present invention the planisphere layer 20 may be in a fixed position relative to the timing movement 82. In some exemplary embodiments the planisphere may be fixably attached to the recessed front portion 18 of the clock case 14 by glue or other types of adhesives. In an exemplary embodiment, it may be preferable that the planisphere layer 20 remains stationary and does not rotate about axis A-A, although some other layers of the clock face 12 may rotate or otherwise be adjusted relative to one another. Although in an exemplary embodiment of the present invention the planisphere layer 20 remains stationary, in other embodiments of the present invention it may be desirable for the planisphere layer to rotate. In these embodiments, the planisphere layer may not be fixably attached to recessed front portion of the clock case.

Figure 11:
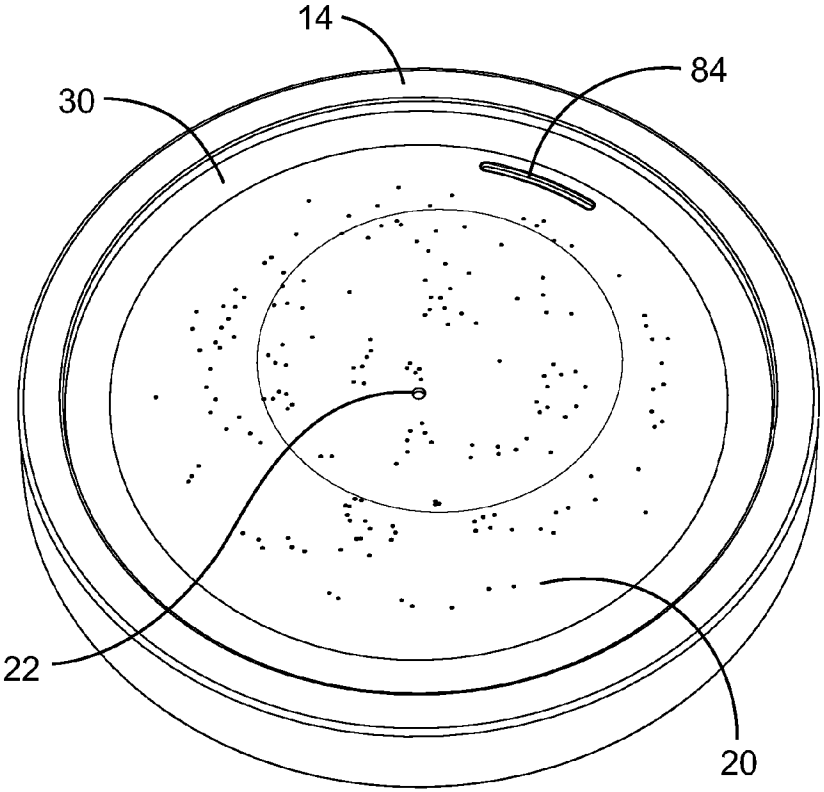
FIG. 11 is a top plan view of an exemplary embodiment of an assembly of the spacer ring, the planisphere layer, and the clock case included in the clock shown in FIG. 1.
Figure 10:
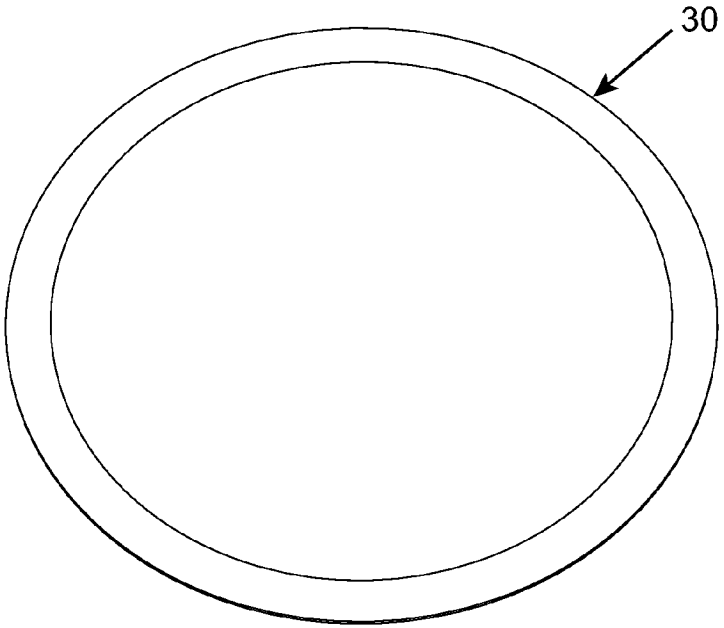
FIG. 10 is a top plan view of an exemplary embodiment of a spacer ring included in the clock shown in FIG. 1.

As shown in FIG. 2, in an exemplary embodiment of the present invention, a spacer ring 30 may be located directly above the planisphere layer 20. FIGS. 10 and 11 show, respectively, a plan view of the spacer ring 30 and a plan view of the spacer ring 30 as assembled with the clock case 14 and planisphere layer 20. The spacer ring 30 may create a sufficient amount of space between the planisphere layer 20 and the sidereal number and calendar ring 50 in order to provide for the unencumbered rotation of the solar time layer 40 relative to the planisphere layer 20. Similar to the planisphere layer 20, in an exemplary embodiment, the spacer ring 30 may optionally fit within the peripheral circumference of the top side of clock case 14. In an exemplary embodiment of the present invention, the cross-sectional width of the spacer ring 30 may be approximately 1 inch, and the thickness of the spacer ring 30 may be about 0.03-inch thick. However, in other embodiments of the present invention, the width and thickness of the spacer ring 30 may vary as desired. As may be seen in FIG. 3, the spacer ring 30 may be held firmly in place between the top side of the planisphere layer 20 and the bottom side of the sidereal number and calendar ring 50. In some embodiments of the present invention, the spacer ring 30 may be held in place by compressive force, an adhesive, or other suitable means. Although an exemplary embodiment of the clock 10 of the present invention may have a spacer ring 30, other exemplary embodiments may not have a spacer ring 30.

As shown in FIG. 3, in an exemplary embodiment of the present invention, a solar time layer 40 may be located between the sidereal number and calendar ring 50 and the planisphere layer 20. As shown in the perspective view of FIG. 12, in an exemplary embodiment, the solar time layer 40 may be circular and substantially flat. A hole 22 may also extend through solar time layer 40 such that the movement shaft 80 of the time movement 82 may optionally pass through. In an exemplary embodiment of the present invention, the portion of hole 22 extending through solar time layer 40 may fit tightly around the hour portion of the movement shaft 80 of time movement 82 such that it may rotate with hour hand 72. In other embodiments of the present invention, solar time layer 40 may be engaged by, secured to, or otherwise be adapted to move with movement shaft 80 such that it may rotate with hour hand 72. FIG. 13 is a top plan view of the solar time layer 40 as assembled with the clock case 14, planisphere layer 20, and spacer ring 30.

In an exemplary embodiment, the solar time layer 40 may have any suitable dimensions. It may be preferable that the solar time layer 40 be made of a clear material so that the user may view the illustrations on the planisphere layer 20 through the solar time layer 40 without any difficulty or distortion. However, in other embodiments of the present invention, it may be desirable to make the solar time layer 40 out of a material that is colored or opaque. Examples of materials that may be used include plastic and glass.

Figure 9:
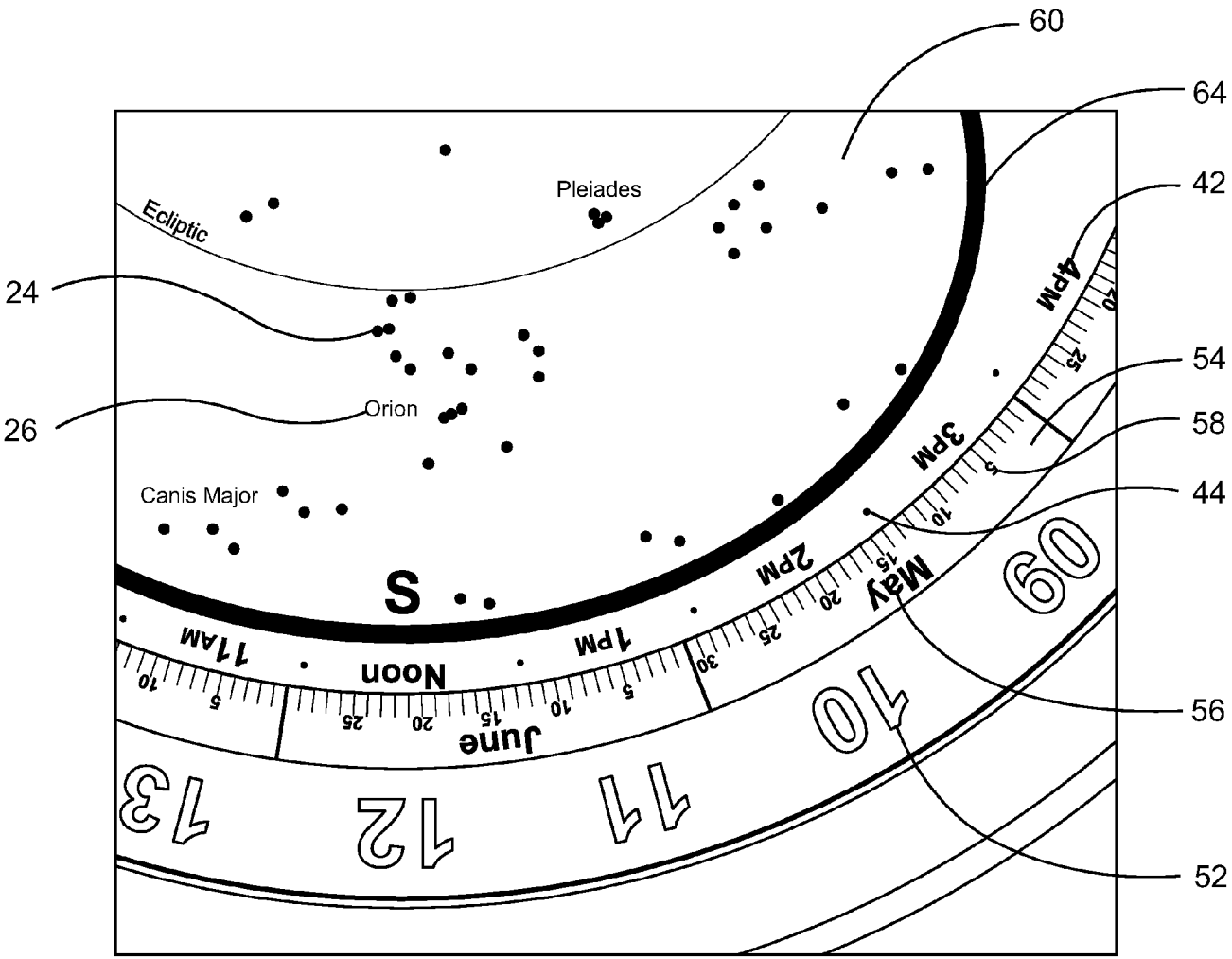
FIG. 9 is a partial top plan view of an exemplary embodiment of a clock of the present invention.
Figure 12:
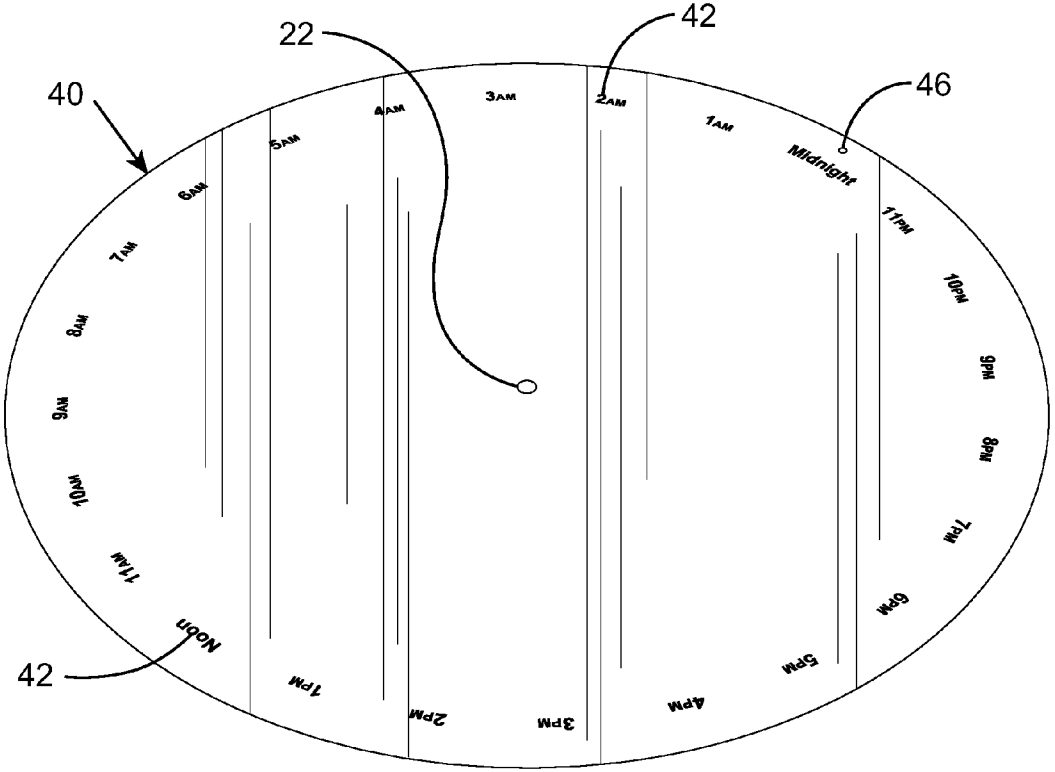
FIG. 12 is a perspective view of an exemplary embodiment of the solar time layer included in the clock shown in FIG. 1.
Figure 13:
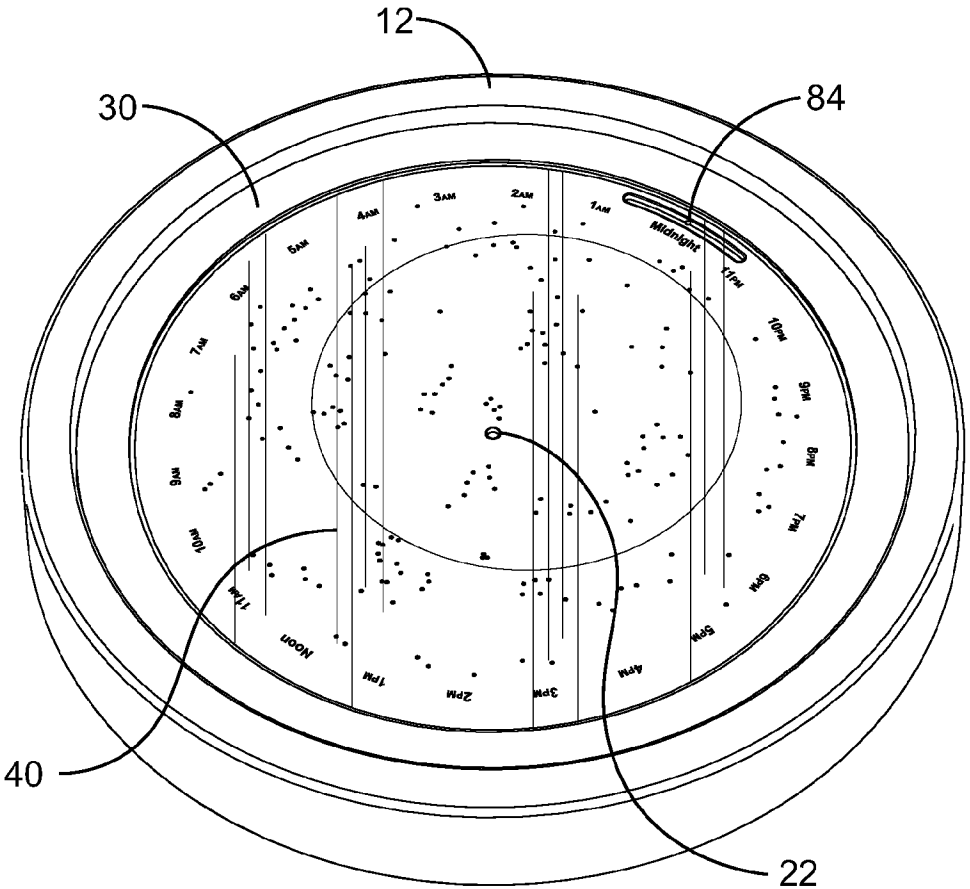
FIG. 13 is a top plan view of an exemplary embodiment of an assembly of the solar time layer, the clock case, the planisphere layer, and the spacer ring included in the clock shown in FIG. 1.

As shown in FIG. 12, in an exemplary embodiment of the present invention, solar hour indicators 42 may be written on the outer perimeter of the solar time layer 40 to facilitate alignment with the calendar information. For example, the solar hour indicators 42 may be located at a sufficient distance away from the center of the solar time layer 40 so that when viewed from a point above the clock face, the solar time layer 40 may encircle the perimeter of the inner portion 28 of the planisphere layer 20. One example of the resulting visual effect may be seen in FIG. 9. In an exemplary embodiment, such as shown in FIG. 9, the solar hour indicators 42 may be written as "Noon", "1 pm", "2 pm", etc., and increase in a counterclockwise fashion. However, in other embodiments of the present invention, the solar hour indicators 42 may be written differently. For example, one embodiment may depict "Noon" as "12 pm" instead. Or, in other embodiments and as shown in FIG. 12, only "Midnight", "6 AM", "6 PM", and "Noon" may be indicated. In some embodiments of the present invention, the solar time layer 40 may also include visual indicators other than the solar hour indicators 42, which may be represented by numbers, letters, or symbols. For example, as shown in FIG. 9, solar half-hours 44 may be marked on the solar time layer 40 in the form of symbols. In other embodiments of the present invention, quarter hour marks or other time marks may also be possible.

Figure 14:
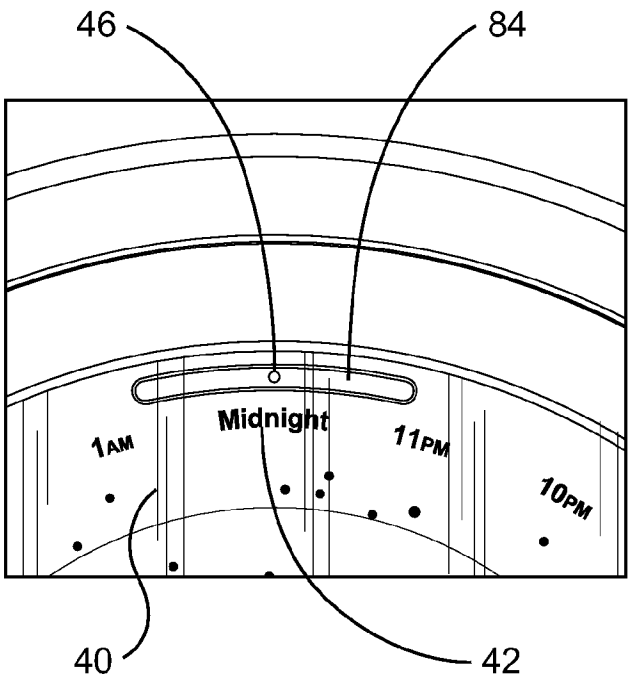
FIG. 14 is a partial top plan view illustrating the exemplary embodiment of the adjustment feature shown in FIG. 13.

As may be seen in FIG. 12, in an exemplary embodiment of the present invention, an adjustment hole, depression, or groove 46 may located at a suitable position in solar time layer 40 (e.g., located along the outer periphery on the outer side of the solar hour indicator 42 for "Midnight"). In this exemplary embodiment of the present invention, the adjustment hole 46 may be circular and sized so that it may accommodate the end of a standard-sized paper clip or any other suitable device for performing the adjustment. A close up view of the adjustment hole 46 of the solar time layer 40 overlaying the adjustment slot 84 through planisphere layer 20 and clock case 14 may be seen in the close-up plan view of FIG. 14. As shown in FIG.

14, when the clock 10 of the present invention is fully assembled, the solar time layer 40 may be positioned in such a way that the adjustment hole 46 may be accessed through the adjustment slot 84 in the clock case 14 and planisphere layer 20. In this way, a user may place a paperclip or any other suitable device through adjustment slot 84 from the back of the clock case 14 and through planisphere layer 20 to place the end of the paper clip or any other suitable device in the adjustment hole 46. The user may then apply the appropriate amount of force to the paper clip or any other suitable device to move the adjustment hole 46 a suitable distance toward one end or another of the adjustment slot 46. In doing so, this will cause the solar time layer 40 to rotate around the movement shaft 80 of the time movement 82. Depending on the amount of force applied to the adjustment hole 46, the user may achieve the desired amount of rotation. When the solar time layer 40 is rotated, the solar hour indicators 42 and any other indicia will rotate relative to the stationary planisphere layer 20.

Although in this exemplary embodiment the adjustment hole 46 may be sized for use with a paper clip, in other embodiments of the present invention a different type of adjustment feature may utilize another size or shape adjustment hole 46, depending on the desired means for adjusting the position of the solar time layer 40. Furthermore, some embodiments of the present invention may contain more than one adjustment hole 46 such as for improving the ease of adjustability. The adjustment slot may have a different size or shape that is not limited to a narrow opening in other embodiments of the invention. In this regard, it should be noted that an adjustable slot may be an opening having any suitable size and shape. Furthermore, in those embodiments of the present invention that do not include an adjustment feature, there may not be an adjustment hole 46 or adjustment slot 84. Moreover, other variations of the adjustability feature are possible. For example, a rotatable wheel or disc may be accessible on the outside of the clock case, and the rotatable wheel or disc may engage the solar time layer in order to adjust it. Other suitable mechanical or electromechanical systems for inducing rotation of the solar time layer 40 may also be used within the scope of the present invention.

Figure 16:
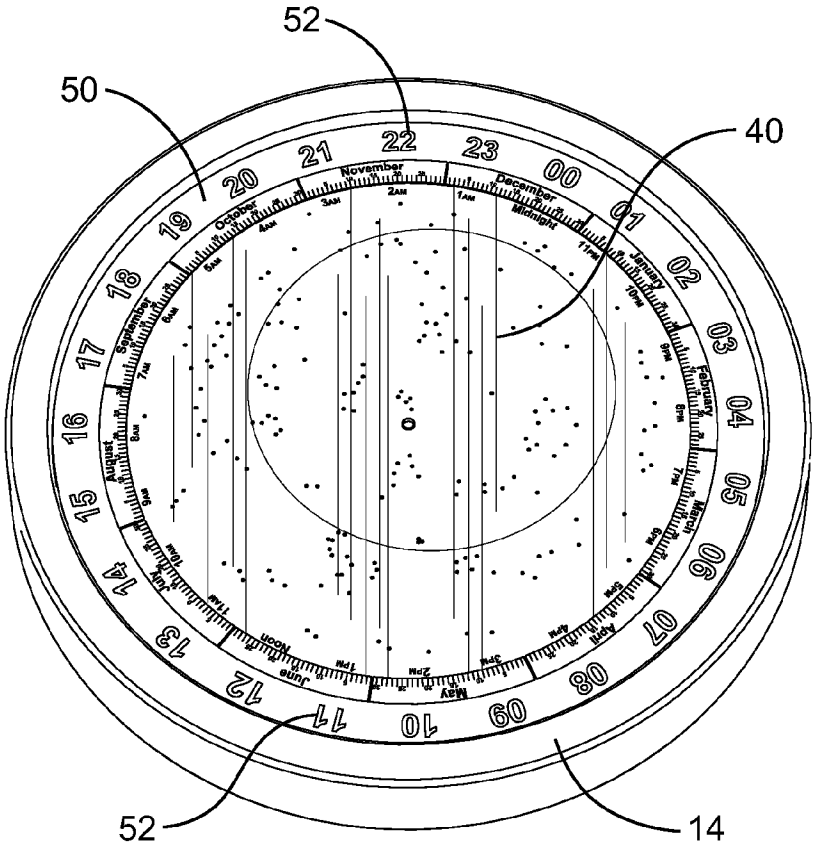
FIG. 16 is a top plan view of an exemplary embodiment of an assembly of the sidereal number and calendar ring, the clock case, the planisphere layer, the solar time layer, and the spacer ring included in the clock shown in FIG. 1.
Figure 15:
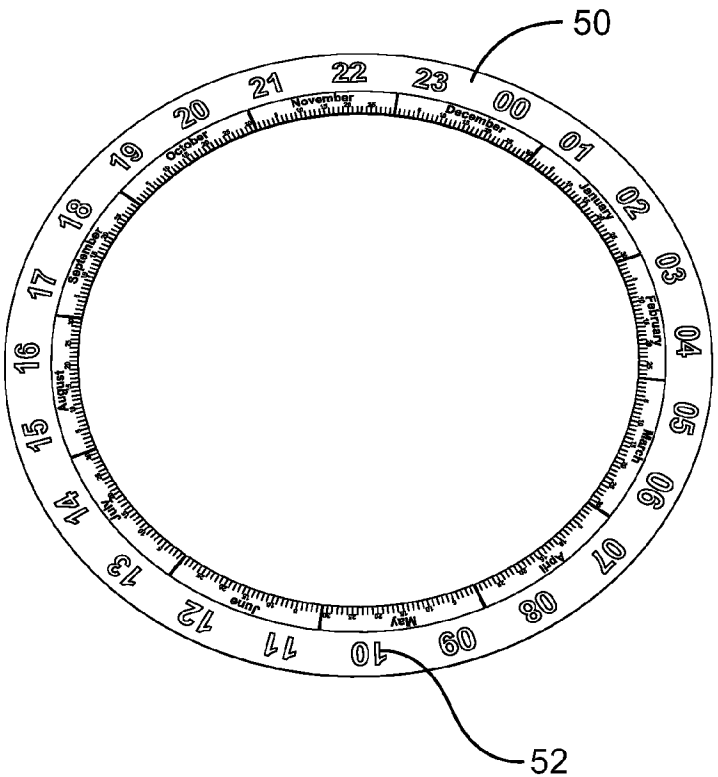
FIG. 15 is a perspective view of an exemplary embodiment of the sidereal number and calendar ring included in the clock shown in FIG. 1.

As may be seen in FIG. 2, located at a position above the solar time layer 40 and directly on top of the spacer ring 30 may be the sidereal number and calendar ring 50. A perspective view of an exemplary embodiment of the sidereal number and calendar ring 50 may be seen in FIG. 15. FIG. 16 shows the sidereal number and calendar ring 50 as assembled with the clock case 14, planisphere layer 20, spacer ring 30, and solar time layer 40 in this exemplary embodiment of the present invention. As may be seen in FIG. 16, like the other layers of the clock face 12 the sidereal number and calendar ring 50 may optionally fit within the peripheral circumference of recessed front portion 18 of the clock case 14. In an exemplary embodiment, the ring may be substantially flat, with a cross sectional width of approximately 1.5 inches and a suitable thickness. However, in other embodiments of the present invention, the dimensions and shape may be varied in order to suit the intended use of the time instrument.

In an exemplary embodiment of the present invention, such as shown in FIG. 9, located on the outer perimeter of the sidereal number and calendar ring 50 may be sidereal numbers 52. The sidereal numbers 52 may identify the sidereal hour time scale, starting with "00" and increasing to "23" or "24" as they circle the clock face 12 in a clockwise fashion. Some embodiments may also include a sidereal minute time scale. In an exemplary embodiment of the present invention the sidereal numbers 52 include sidereal minutes that circle the clock face 12 in intervals of 5, starting with "0" and increasing to "55" or "60." In an exemplary embodiment of the present invention, the sidereal numbers 52 may be large enough so that they may be easily read by the user. Different font styles may be used to make the sidereal numbers 52 easier to read. In an exemplary embodiment of the present invention, such as shown in FIG. 9, the even numbers may be solid, while the odd numbers may be outlined. However, in other embodiments of the present invention, different symbols, font styles, combinations, color schemes, or other visual effects may be used to make the sidereal numbers 52 easy to read by the user.

Such as shown in FIG. 9, along the inner perimeter of the sidereal number and calendar ring 50 may be a calendar 54 with indicia designating the months and days of the year. Month indicia 56 and daily indicia 58 may increase throughout the calendar year in a clockwise fashion as they circle the clock face 12. In an exemplary embodiment of the present invention, the month indicia 56 may be the words "January", "February", "March", etc. However, in other embodiments, different abbreviations or indicia may be used for the months. In an exemplary embodiment, the daily indicia 58 may be located on the inner side of the month indicia 56. Such as shown in FIG. 9, the daily indicia 58 may include larger, numbered indicia for every $5^{th}$ day of a month, and smaller, unmarked indicia for every other day of a month. In other embodiments of the present invention, different combinations of indicia may be used as the daily indicia 58. Also, in some embodiments only certain months or days may be indicated on the calendar 54. An example would be an embodiment where only every $5^{th}$ day is indicated. In other embodiments, only the seasons of the year may be indicated, with no mention of the months or days.

Although in an exemplary embodiment, the sidereal numbers 52 and calendar 54 may be on the same ring, in other embodiments of the present invention they may be on two separate rings. In these embodiments, the sidereal number and calendar rings may be sized such that when the clock 10 of the present invention is assembled, the information on both rings may be read by the user.

Figure 17:
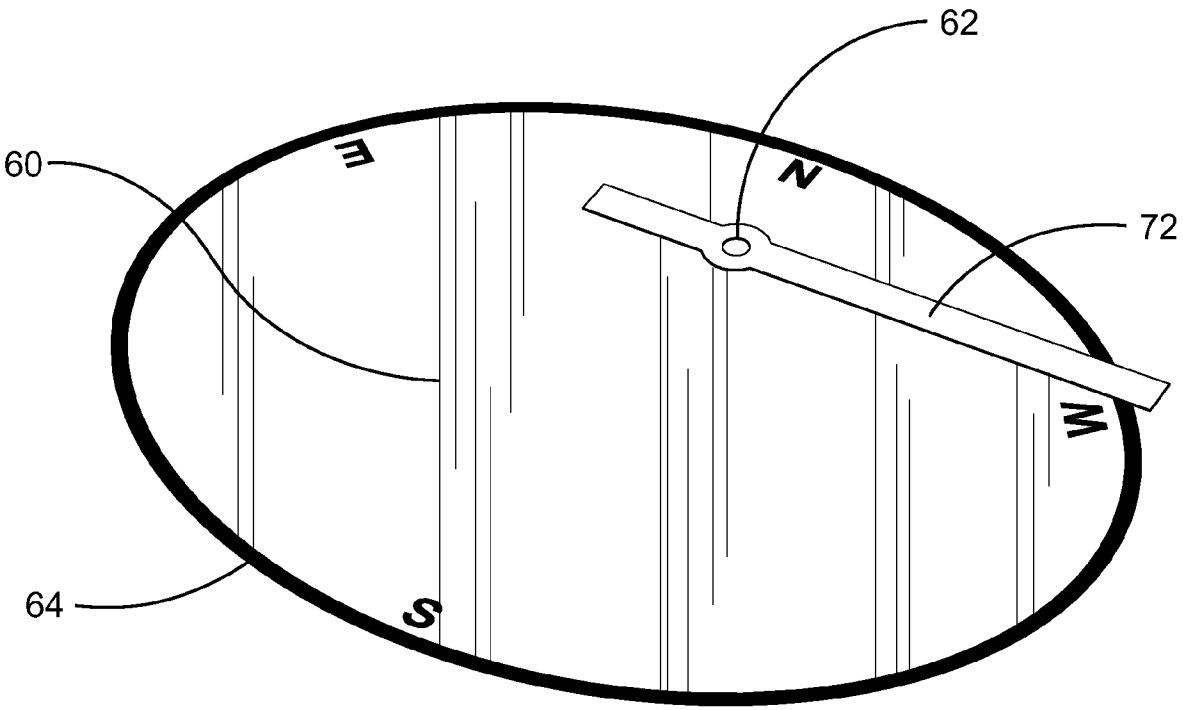
FIG. 17 is a perspective view of an exemplary embodiment of the sky indicator and hour hand included in the clock shown in FIG. 1.
Figure 18:
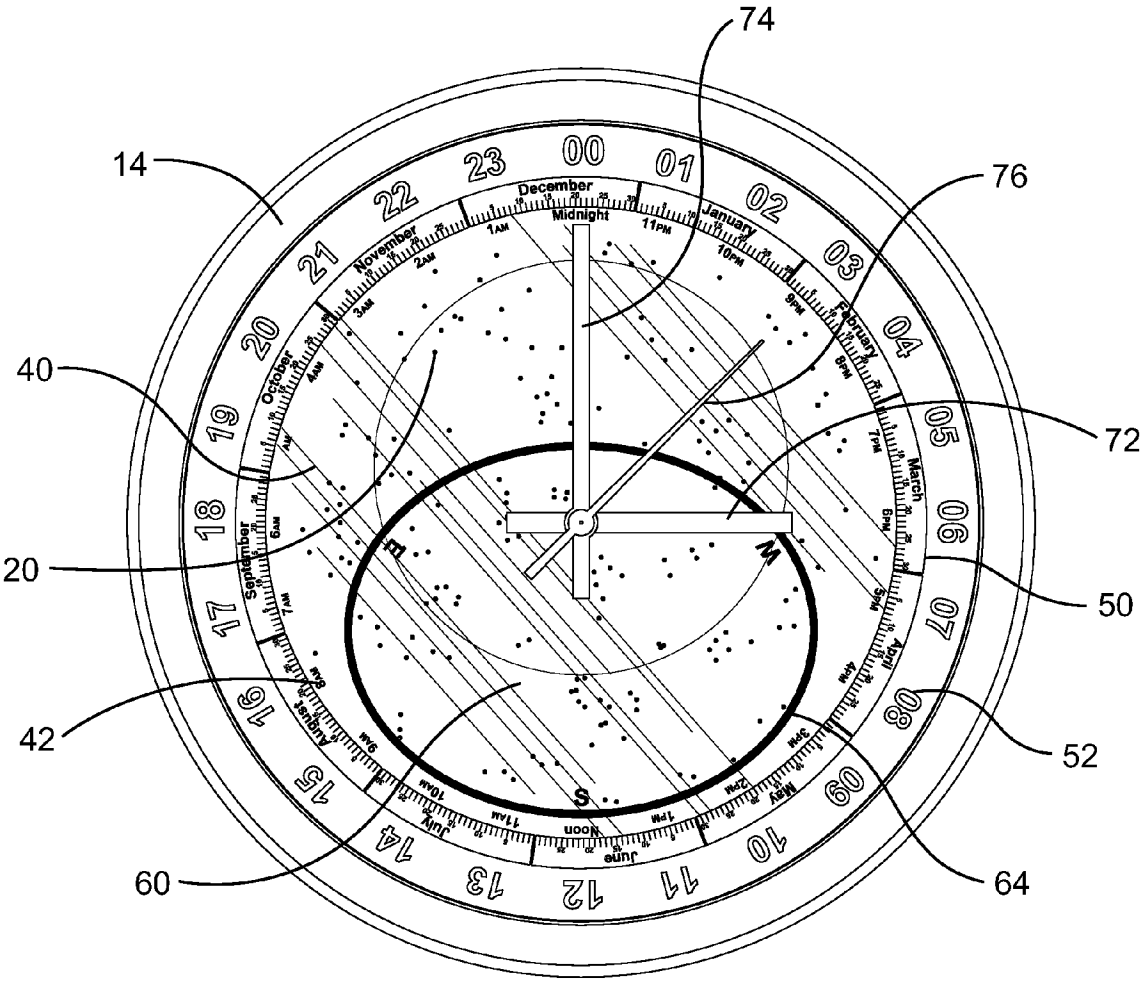
FIG. 18 is a top plan view of the clock shown in FIG. 9.

In an exemplary embodiment of the present invention, the topmost layer of the clock face 12 may be the indicator layer 60. In an exemplary embodiment, such as shown in the perspective view of FIG. 17, the indicator layer 60 may be substantially flat, with an elliptical shape and a border 64. The indicator layer 60 may be sized accordingly to represent the portion of the planisphere that may be visible at a given time. In those embodiments where the planisphere is a celestial planisphere, the indicator layer 60 may indicate a portion of the sky visible at a given time. In an exemplary embodiment of the present invention, the indicator layer 60 may be a 6.3-inch×5-inch oval. However, in other embodiments, the indicator layer 60 may have any desired shape and dimensions such that at least a desired portion of the visible sky may be indicated. An aperture 62 may be provided in a suitable location and sized to accommodate the movement shaft 80 of the timing movement 82. In particular, similar to a conventional planisphere, indicator layer 60 may be positioned relative to solar time layer 40 such that solar noon may be aligned with Noon on the solar time layer 40 such as shown in the example of FIG. 9. In an exemplary embodiment, the indicator layer 60 may be attached to the hour hand 72 or otherwise connected to the movement shaft 80 so that it may rotate in a clockwise manner at substantially the same speed as hour hand 72. In an exemplary embodiment, the indicator layer 60 may be positioned in relation to the hour hand 72 such that the outlined border 64 provides the user with an accurate representation of the part of the sky that is visible at the sidereal time (i.e., sidereal number 52) being indicated by the hour hand 72. In some embodiments of the present invention the indicator layer 60 may also have symbols on it to indicate North, South, East, and West positions.

In an exemplary embodiment, the indicator layer 60 may be sufficiently clear so that the planisphere layer 20 below may be seen by the user when the clock is assembled. However, in other embodiments of the present invention, the indicator layer 60 may be partly or wholly tinted.

Other variations of an indicator layer 60 are possible and within the scope of the present invention. In some embodiments of the present invention, the indicator layer 60 may be circular and have a similar size and shape as the visible portion of the planisphere layer when the clock is assembled. In such an embodiment, the indicator layer 60 may have an elliptical shape outlined on it or cut out of it that may provide a similar visual effect as the aforementioned bordered outline 64 of the exemplary embodiment of indicator layer 60. In another embodiment, the entire indicator layer 60 may be tinted, except for a desired portion that may be cutout or sufficiently clear in order to show the desired visible portion of the sky. In yet another embodiment, the indicator layer 60 may not be a separate layer. For example, an indicator layer 60 may also be a cutout or a sufficiently clear portion in a solar time layer 40 such that a desired portion of the visible sky may be indicated by a planisphere layer 20. In such an embodiment, it should still be understood that there is an indicator layer and a solar time layer. Moreover, in those embodiments of the present invention in which a planisphere layer may be illustrated with a terrestrial planisphere, such as the embodiment shown in FIG. 19, the indicator layer may, for accuracy, have several indicator lines or other suitable features so that when fully assembled the timepiece may accurately account for seasonal, longitudinal shifts in the day/night terminator line (i.e., longer days in summer, shorter days in winter), which is a result of the earth's tilted axis and the earth's physical coordinates on the course of its yearly circuit around the sun.

Although an exemplary embodiment of the present invention may include all of the layers as shown in FIGS. 1 and 2, some embodiments of the present invention may have different numbers or configurations of layers. Also, some layers or timepiece features may be omitted in some exemplary embodiments of the present invention. As mentioned, in some embodiments, the space ring 30 may not be present, and the sidereal number and calendar ring 50 may be replaced by separate layers. In another exemplary embodiment, the solar time layer 40 may be located below the planisphere layer 20. In some embodiments, the solar time layer 40 and the indicator layer 60 may be combined into one layer. Other variations are also possible and considered to be within the scope of the present invention.

As shown in FIGS. 1 and 2, there may be clock hands mounted in a suitable manner to the movement shaft 80 of the timing movement 82 to allow for the accurate measurement of time. The clock hands may be initially set in any suitable manner (e.g., like the hands of a conventional clock). In an exemplary embodiment of the present invention, the hands (i.e., second hand 76, minute hand 74, and hour hand 72) may be above the layers of the clock face 12. However, in other embodiments of the present invention, some or all of the clock hands may be situated beneath one or more layers of the clock face, and there may be fewer than three clock hands. For example, a clock may have only an hour hand 72, or may have only a minute hand 74 and hour hand 72.

In an exemplary embodiment of the present invention, the clock 10 may include a front cover, bezel, or any suitable type of housing that may be secured to the clock case in a suitable manner to protect or enclose clock face 12. It may be preferable that a front cover be made out of a clear material such as plastic or glass. For example, in those embodiments of the present invention where the clock 10 may be integrated into a watch, the front cover may be made out of any materials suitable for making watch crystals. These materials may include glass, Plexiglas, plastic, mineral glass, sapphire glass, or other similar or suitable materials. However, in some embodiments of the present invention, different materials may also be used.

In an exemplary embodiment of the present invention, the timing movement 82 may be an automatic quartz movement that provides sidereal hours, minutes, and seconds. In one exemplary embodiment of the present invention, the timing movement may be a standard size of 2.2 inches by 2.2 inches. However, in other embodiments the timing movement may be smaller or larger depending on the size of the clock 10. The timing movement 82 may be either a sweep movement or a tick movement. In an exemplary embodiment, the timing movement 82 may be a tick movement that runs at the sidereal rate of about 1 tick per every 0.997270 seconds.

In an exemplary embodiment of the present invention, any suitable timing movement may be utilized. For example, an automatic timing movement may be manufactured with a unique quartz crystal adapted to provide the correct frequency for sidereal timing. Alternatively, a sidereal timing movement may be created from an existing automatic solar hour timing movement. For instance, an existing quartz solar timing movement may be reconfigured or otherwise modified to convert it to operate at the sidereal timing frequency. For another example, an automatic quartz sidereal timing movement may also be created by placing a suitable electrical device or circuit (e.g., an integrated such as a programmable microcontroller or microprocessor) in electrical communication with an automatic quartz solar timing movement in order to convert it to operate at the sidereal timing frequency. Other electrical, mechanical, electromechanical, or otherwise suitable timing movements may also be used in other exemplary embodiments of the present invention.

In different embodiments of the timepiece of the present invention, the size of the timepiece may vary depending on its intended use. The measurements provided as the exemplary embodiments may be of sufficient size for a clock to be displayed on a wall. For example, in some embodiments of the present invention, a timepiece may be part of a relatively large structure either intended to be hung on a wall or displayed in another fashion. Furthermore, in some embodiments, a clock may be integrated into a relatively large structure along with another type of time, weather, or astronomical measurement instrument. For example, a clock of the present invention and a solar time clock (e.g., an analog or digital clock that provides local time) may both be integrated into a structure intended to be hung on a wall or otherwise displayed. In yet another embodiment of the present invention, a clock of the present invention with a celestial planisphere and a clock of the present invention with a terrestrial planisphere may be displayed together. However, in other embodiments of the timepiece of the present invention, the timepiece may be of a smaller, more portable size so that it may be taken with the user to assist the user during star gazing or other activities. In another embodiment of the present invention, the timepiece may be a watch that may be worn by the user. Accordingly, it must be recognized that any dimensions provided herein are merely for the purpose of example only and are not intended to limit the present invention, unless expressly claimed otherwise.

An exemplary embodiment of the present invention may be manufactured from any suitable materials. For example, the layers of a clock face 12 may be comprised of opaque, translucent, or transparent substrates or of any combination thereof. Some examples of materials that may be used for the substrates include, but are not limited to, paper, cardboard, plastic, glass, fiberglass, metal, or any other similar or suitable materials.

In some embodiments of the present invention, the clock 10 may include means for illuminating the clock face 12. For example, lighting means may be placed either in the front side of the clock 10, within the clock case, or behind the layers to create a backlighting effect. Furthermore, in some embodiments of the present invention, red lighting may be used to illuminate the clock face 12. In these embodiments, the clock face 12 may be more conducive to star gazing since, unlike white light, red light may not shrink the pupils of the eyes and make star gazing difficult. For those embodiments that embody the timepiece as a watch, the face may be illuminated by the usual means for lighting watch faces, including electroluminescent means such as INDIGLO by TIMEX®.

Those embodiments of the present invention that include an adjustment feature and a sidereal time and calendar ring 50 may allow a user to adjust the positioning of the solar time layer 40 relative to the sidereal time and calendar ring 50 according to his or her specific geographic location. To determine the amount of adjustment, the user may consult a chart such as the one shown in FIG. 19. The user may use his or her longitude to derive from the chart the date when midnight in solar time occurs at "06" (i.e., 6:00:00 or 6 o'clock hour) in sidereal time. Once the date is interpolated from the chart, or otherwise provided to the user, the user may adjust the solar time layer 40 relative to the sidereal time and calendar ring 50 so that the desired date is aligned with "midnight" on the solar time layer 40. An example of this would be a user who lives in Columbus, Ohio. Columbus, Ohio has a longitude of approximately −83 degrees, or 83 degrees west of the prime meridian. Since Columbus is −5 UTC (i.e., Eastern Standard Time), and 83 degrees is greater than 75, the chart shows that the desired date is December $29^{th}$. A user in Columbus, Ohio may then adjust his or her clock so that "midnight" is aligned with December $29^{th}$.

Figure 19:
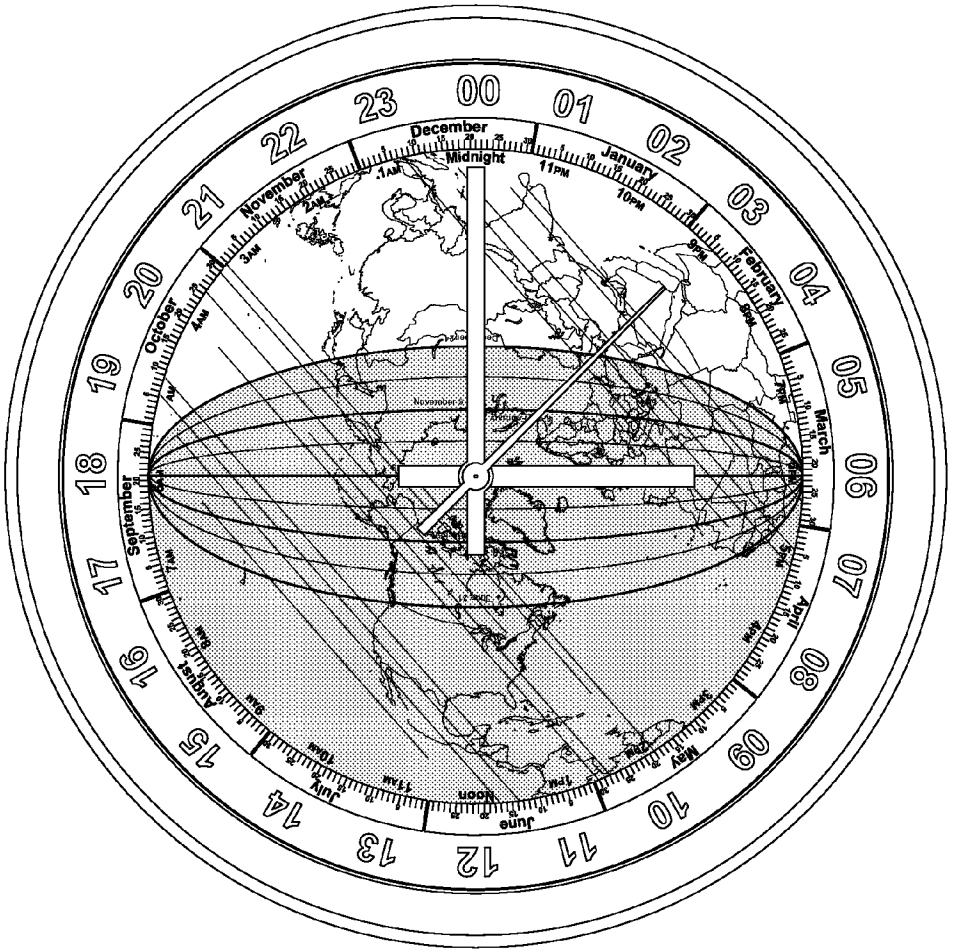
FIG. 19 is a top plan view of an exemplary embodiment of a terrestrial planisphere clock of the present invention.

Information regarding the proper adjustment may be provided to the user in different ways. For example, the user may be provided with a chart like that shown in FIG. 19. Alternatively, the user may enter his or her longitude into a website that calculates the correct date for the user, or a chart such as shown in FIG. 19 may be available by internet access to a website. Likewise, information for initially setting the clock hands may be provided to a user in any similar or suitable manner.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention.

What is claimed is:

1. A timepiece, comprising:

a timing movement adapted to operate at a sidereal rate; and a planisphere layer positioned in an orientation to said timing movement;

an indicator layer adapted to indicate a particular selection of said planisphere layer;

a solar time layer having solar time indicia; and a calendar layer having calendar indicia such that solar time is adapted to be indicated by a relationship between said solar time layer and said calendar layer;

wherein said timing movement is adapted to change said particular selection of said planisphere during typical timing operation; and wherein the timepiece is further adapted to indicate solar time and sidereal time in association with only one mechanical rate of time during typical timing operation.

2. The timepiece of claim 1, wherein said timepiece is a watch.

3. The timepiece of claim 1, wherein:

said planisphere layer is adapted to be positioned in a substantially fixed orientation relative to a casing during typical timing operation;

said indicator layer is adapted to rotate in association with said timing movement during typical timing operation to indicate said particular selection of said planisphere layer; and said timing movement is adapted to change said particular selection of said planisphere during typical timing operation.

4. A timepiece, comprising:

a timing movement having a movement shaft forming an axis; and a planisphere layer positioned in an orientation to said timing movement, said planisphere layer adapted to visually display a planisphere;

an indicator layer in association with said planisphere layer, said indicator layer adapted to indicate a particular portion of said planisphere;

a solar time layer in association with said planisphere layer and said indicator layer, said solar time layer adapted to indicate solar time; and a calendar layer in association with said solar time layer, said calendar layer having calendar indicia such that solar time is adapted to be indicated by a relationship between said solar time layer and said calendar layer.

5. The timepiece of claim 4, further comprising an adjustability feature adapted to change the relative orientation of the solar time layer with respect to the indicator layer.

6. The timepiece of claim 5, wherein said adjustability feature is comprised of an adjustment slot in the planisphere layer and at least one adjustment hole in the solar time layer.

7. The timepiece of claim 4, further comprising an hour hand in association with said movement shaft and said indicator layer such that said hour hand and said indicator layer are adapted to rotate together about said axis during typical timing operation.

8. The timepiece of claim 4, wherein said timing movement is adapted to operate at a sidereal rate.

9. The timepiece of claim 4, further comprising a sidereal layer in association with said planisphere layer, said sidereal layer depicting a desired time scale.

10. The timepiece of claim 4, wherein said calendar layer is adapted to indicate the months and days of the year.

11. The timepiece of claim 4, wherein said planisphere layer depicts celestial information.

12. The timepiece of claim 4, wherein said planisphere layer depicts terrestrial information.

13. The timepiece of claim 4, wherein the timepiece is adapted to indicate solar time and sidereal time in association with only one mechanical rate of time during typical timing operation.

14. The timepiece of claim 4 wherein said indicator layer is adapted to rotate about said axis during typical timing operation.

15. The timepiece of claim 4 wherein said solar time layer is adapted to rotate about said axis during typical timing operation.

16. A clock, comprising:

a timing movement having a movement shaft forming an axis, said movement shaft in association with an hour hand and a minute hand;

a planisphere layer adapted to be positioned in a substantially fixed orientation relative to a casing during typical timing operation, said planisphere layer adapted to visually display a planisphere;

an indicator layer in association with said planisphere layer, said indicator layer further adapted to indicate a particular portion of said planisphere associated with a particular time;

a solar time layer in association with said planisphere layer and said indicator layer, said solar time layer adapted to indicate solar hours;

a calendar layer in association with said solar time layer, said calendar layer having calendar indicia such that solar time is adapted to be indicated by a relationship between said solar time layer and said calendar layer; and an adjustability feature comprised of:

(a) an adjustment slot located in said planisphere layer, and (b) at least one adjustment hole located in said solar time layer; said at least one adjustment hole adapted to be accessed through said planisphere layer;

wherein the orientation of said solar time layer is adapted to be adjusted with respect to said indicator layer; and wherein the clock is adapted to indicate solar time and sidereal time in association with only one mechanical rate of time during typical timing operation.

17. The clock of claim 16, wherein said hour hand is in association with said indicator layer such that said hour hand and said indicator layer are adapted to rotate together about said axis during typical timing operation.

18. The clock of claim 16, wherein said timing movement is adapted to operate at a sidereal rate.

19. The clock of claim 16, further comprising a sidereal layer in association with said planisphere layer, said sidereal layer depicting a desired time scale.

20. The clock of claim 16, wherein said calendar layer is adapted to indicate the months and days of the year.

21. The clock of claim 16, wherein said planisphere layer depicts celestial information.

22. The clock of claim 16, wherein said planisphere layer depicts terrestrial information.

23. The clock of claim 16, wherein said clock is contained within a clock case.

24. The clock of claim 16, further comprising lights adapted to illuminate a clock face.

25. The timepiece of claim 16 wherein said indicator layer is adapted to rotate about said axis during typical timing operation.

26. The timepiece of claim 16 wherein said solar time layer is adapted to rotate about said axis during typical timing operation.

* * * * *

UNITED STATES PATENT AND TRADEMARK OFFICE

CERTIFICATE OF CORRECTION

PATENT NO. : 7,518,956 B1
APPLICATION NO. : 11/537129
DATED : April 14, 2009
INVENTOR(S) : Douglas Hansel It is certified that error appears in the above-identified patent and that said Letters Patent is hereby corrected as shown below:

In column 13, line 21 please delete "layer, said indicator layer further adapted to indicate a" and insert --layer, said indicator layer adapted to indicate a--

Signed and Sealed this

Nineteenth Day of May, 2009

John Doll

JOHN DOLL
*Acting Director of the United States Patent and Trademark Office*